US007481270B2

(12) United States Patent
Shepler

(10) Patent No.: US 7,481,270 B2
(45) Date of Patent: Jan. 27, 2009

(54) SUBSEA PUMPING SYSTEM

(75) Inventor: Randall A. Shepler, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 171 days.

(21) Appl. No.: 11/163,959

(22) Filed: Nov. 4, 2005

(65) Prior Publication Data

US 2006/0162934 A1 Jul. 27, 2006

Related U.S. Application Data

(60) Provisional application No. 60/522,802, filed on Nov. 9, 2004.

(51) Int. Cl.
*E21B 43/01* (2006.01)

(52) U.S. Cl. ..... 166/105; 166/335; 137/565.3; 137/565.33

(58) Field of Classification Search ..... 166/370, 166/335, 368, 68, 105; 417/3, 4, 62, 203, 417/202, 201, 205, 199.1, 248, 244; 137/565.29, 137/565.3, 565.33
See application file for complete search history.

(56) References Cited

U.S. PATENT DOCUMENTS

| | | | | |
|---|---|---|---|---|
| 1,980,985 | A * | 11/1934 | Deming | 418/13 |
| 2,361,231 | A * | 10/1944 | Nebolsine | 210/170.1 |
| 3,232,524 | A * | 2/1966 | Rice et al. | 417/246 |
| 4,641,679 | A * | 2/1987 | Arnaudeau et al. | 137/88 |
| 4,830,584 | A | 5/1989 | Mohn | |
| 4,848,471 | A * | 7/1989 | Bencze | 166/335 |
| 5,628,616 | A | 5/1997 | Lee | |
| 5,820,354 | A * | 10/1998 | Wild et al. | 417/244 |
| 6,230,810 | B1 * | 5/2001 | Rivas | 166/357 |
| 6,651,745 | B1 | 11/2003 | Lush et al. | |
| 6,688,392 | B2 | 2/2004 | Shaw | |
| 6,926,504 | B2 * | 8/2005 | Howard | 417/417 |
| 2003/0015346 | A1 | 1/2003 | McCall | |
| 2003/0170077 | A1 | 9/2003 | Herd et al. | |
| 2004/0099422 | A1 | 5/2004 | Lush et al. | |
| 2005/0145388 | A1 | 7/2005 | Hopper | |
| 2006/0118310 | A1 * | 6/2006 | Euphemio et al. | 166/368 |

FOREIGN PATENT DOCUMENTS

| | | | |
|---|---|---|---|
| EP | 1353038 | A1 | 10/2003 |
| FR | 2748532 | A1 | 11/1997 |
| GB | 2071766 | A * | 9/1981 |
| GB | 2208411 | A | 3/1989 |
| GB | 2312929 | A | 11/1997 |
| GB | 2376250 | A | 12/2002 |
| WO | 03087535 | A1 | 10/2003 |

* cited by examiner

*Primary Examiner*—Kenneth Thompson
(74) *Attorney, Agent, or Firm*—Kevin B. McGoff; James L. Kurka

(57) ABSTRACT

A pumping system is disclosed for producing hydrocarbons from a subsea production well with at least one electrical submersible pumping (ESP) hydraulically connected to at least one multiphase pump to boost production fluid flow.

13 Claims, 5 Drawing Sheets

SUBSEA PUMPING SYSTEM

CROSS-REFERENCE TO RELATED APPLICATIONS

This application claims the benefit under 35 U.S.C. §119 (e) of US Provisional Application Ser. No. 60/522,802, entitled, "SUBSEA PUMPING SYSTEM," filed on Nov. 9, 2004.

TECHNICAL FIELD

The present invention relates generally to enhancements in boosting of hydrocarbons from a subsea production well, and more particularly to a system for producing hydrocarbons utilizing a multiphase pump to condition and pressure hydrocarbons before entering a primary booster pump comprising centrifugal pump stages used in one or more electrical submersible pumps.

BACKGROUND

A wide variety of systems are known for producing fluids of economic interest from subterranean geological formations. In formations providing sufficient pressure to force the fluids to the earth's surface, the fluids may be collected and processed without the use of artificial lifting systems. Where, however, well pressures are insufficient to raise fluids to the collection point, artificial means are typically employed, such as pumping systems.

The particular configurations of an artificial lift pumping systems may vary widely depending upon the well conditions, the geological formations present, and the desired completion approach. In general however, such systems typically include an electric motor driven by power supplied from the earth's surface. The motor is coupled to a pump, which draws wellbore fluids from a production horizon and imparts sufficient head to force the fluids to the collection point. Such systems may include additional components especially adapted for the particular wellbore fluids or mix of fluids, including gas/oil separators, oil/water separators, water injection pumps, and so forth.

One such artificial lift pumping system is an electrical submersible pump (ESP). An ESP typically includes a motor section, a pump section, and a motor protector to seal the clean motor oil from wellbore fluids, and is deployed in a wellbore where it receives power via an electrical cable. An ESP is capable of generating a large pressure boost sufficient to lift production fluids even in ultra deep-water subsea developments. However, ESPs are typically confined by the amount of free gas content they can handle (especially at low intake pressures).

Another artificial lift pumping system is a multiphase pump (MPP). MPPs may, for example, include helico-axial, twin-screw and piston pumps, and are important for artificial lift in subsea oil and gas field operations (especially, in ultra deep-water subsea developments). MPPs can handle high gas volumes as well as the slugging and different flow regimes associated with multiphase production, including flows having high water and/or high gas content (as high as 100-percent water or gas). Using MPPs allows development of remote locations or previously uneconomical fields. Additionally, since the surface equipment, including separators, heater-treaters, dehydrators and pipes, is reduced, the impact on the environment is also reduced. A production deficiency, however, is that MPPs are typically not able to provide the high pressure required, without a large number of pumps aligned in series.

Accordingly, it would be advantageous to provide an artificial lift pumping system capable of handling a production fluid with various phase flow regimes while providing a sufficient pressure boost to lift the production fluid to a collection location.

SUMMARY

In general, according to one embodiment, the present invention provides a system for boosting subsea production fluid flow via a combination pumping system comprising one or more multiphase pumps and one or more electrical submersible pumps. The pumping system receives production fluid flow via one or more import lines and distributes pressure-boosted production flow via one or more export lines.

Other or alternative features will be apparent from the following description, from the drawings, and from the claims.

BRIEF DESCRIPTION OF THE DRAWINGS

The manner in which these objectives and other desirable characteristics can be obtained is explained in the following description and attached drawings in which.

It is to be noted, however, that the appended drawing(s) illustrate only typical embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Generally, in some embodiments of the present invention, a solution is provided to overcome the deficiencies in multiphase pump and electrical submersible pump artificial lift systems by combining the two systems. In accordance with the present invention, an improved artificial lift pumping system includes one or more MPPs in hydraulic connection with one or more ESPs. In one embodiment, the present invention includes to a system for producing hydrocarbons utilizing a seabed based MPP to condition and pressure hydrocarbons before entering a primary booster pump made up of centrifugal pump stages used in one or more ESPs.

Figure 1:
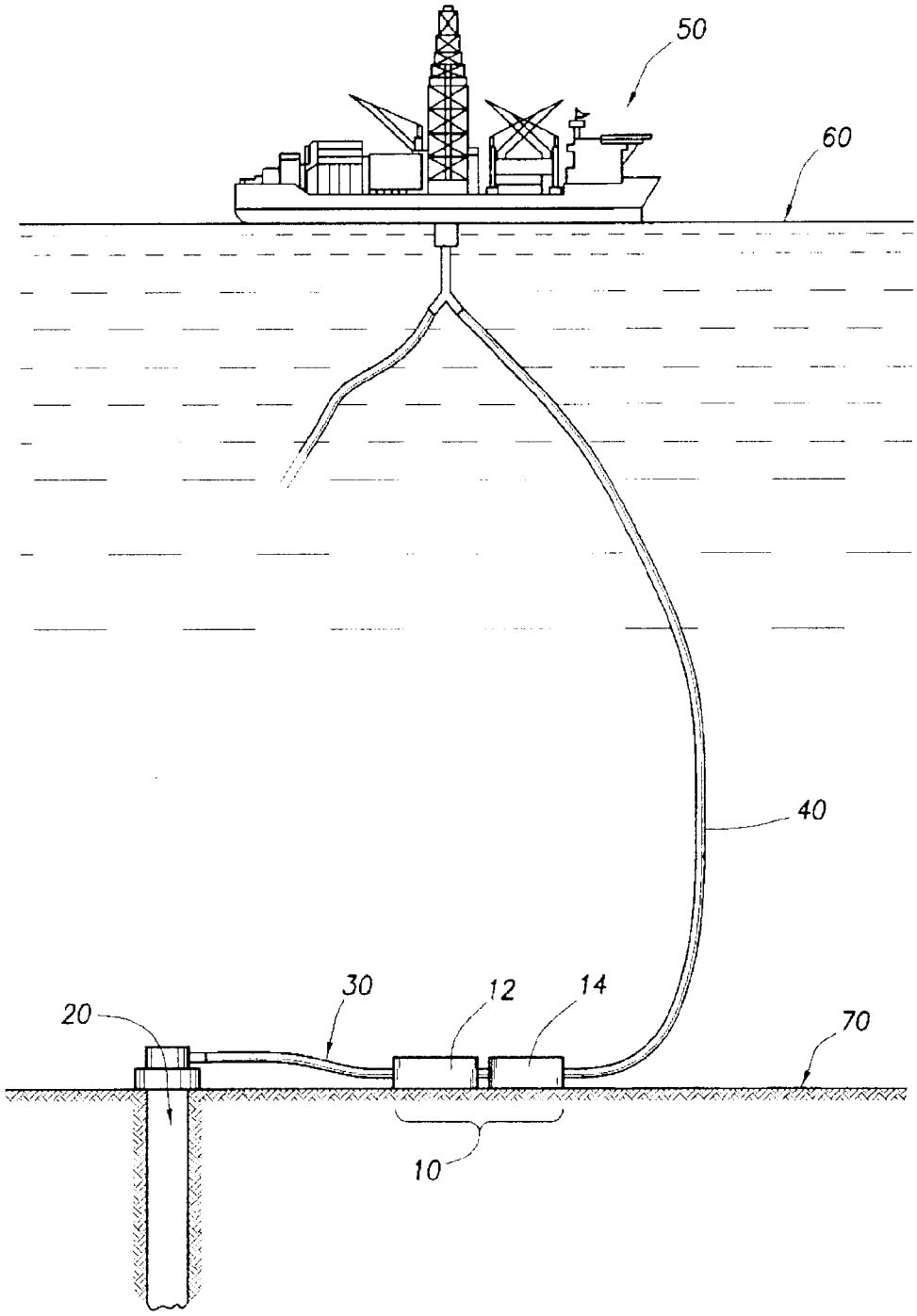
FIG. 1 illustrates a profile view of a composite pumping system in accordance with the present invention deployed subsea.

With reference to FIG. 1, in one embodiment of the present invention, a combination pumping system 10 is provided for lifting production fluid (e.g., oil, gas, water, or a combination thereof) from a well 20 via an import line (e.g., pipe, tube, or other conduit). The pumping system 10 includes one or more MPPs 12 and one or more ESPs 14 for receiving the production fluid (which may include various ranges of oil, gas, and water content) and lifting the production fluid via an export line 40 (e.g., riser, pipe, tube, or other conduit) to a target location such as a collection point on a vessel 50 deployed on the surface 60. In some embodiments, the pumping system 10 may be arranged on the seabed 70 adjacent to the well 20.

Figure 2:
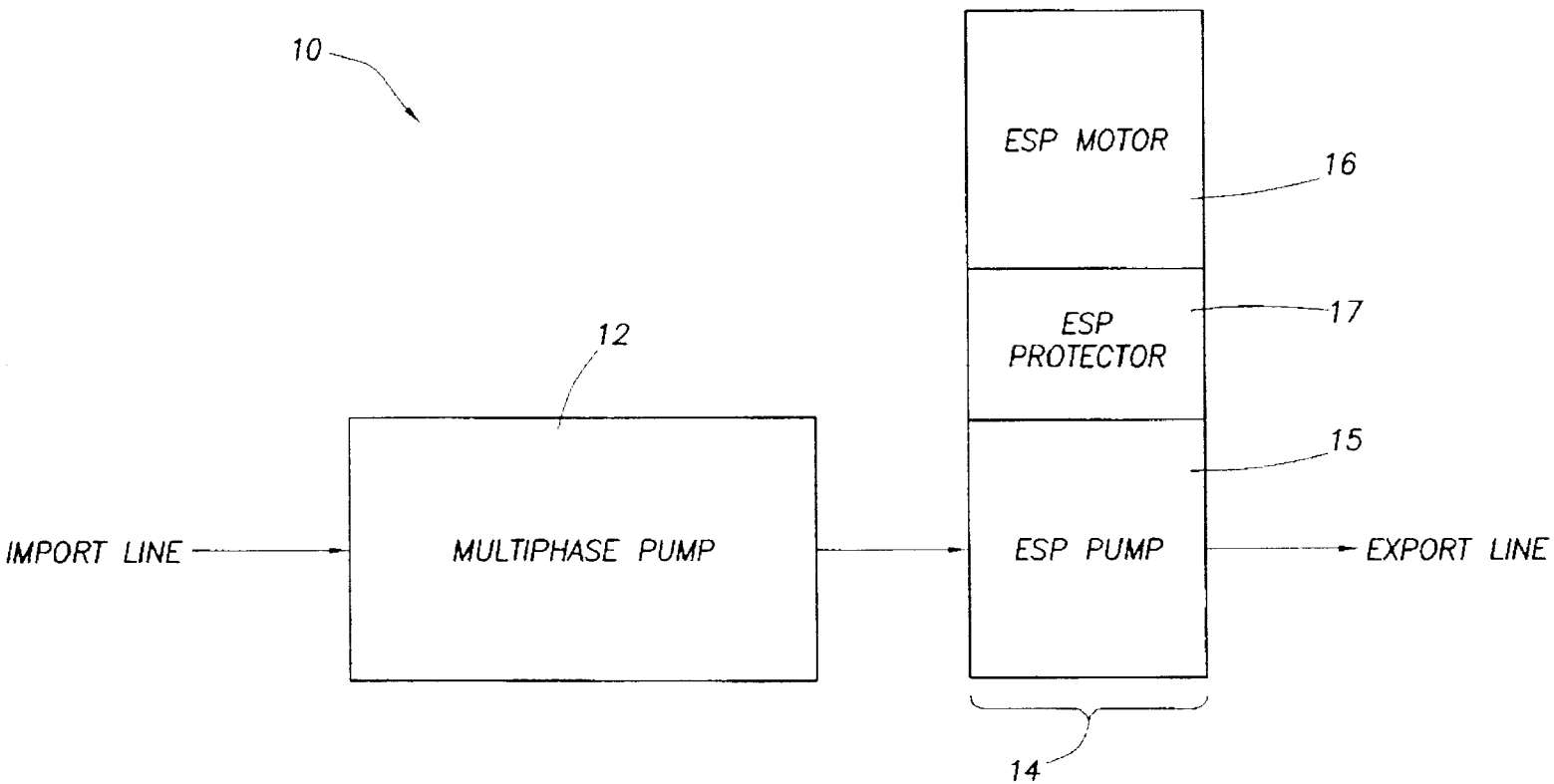
FIG. 2 illustrates a schematic view of a composite pumping system in accordance with the present invention.

FIG. 2 illustrates an embodiment of the present invention where an import line 10 carrying production fluid feeds into an MPP or, in other embodiments, a plurality of MPPs. Typically, the production fluid has a liquid component and a gas component. The MPP boosts the pressure of the input production fluid to a particular level to compress or move a sufficient volume of the liberated gas component into solution such that the production fluid may be pumped by an ESP 30 or, in other embodiments, a plurality of ESPs. The acceptable gas-to-liquid ratio may vary depending on the characteristics of the ESP 30. For example, some ESP centrifugal stages cannot handle any percentage volume of liberated gas, while others may efficiently pump higher volumes of fluids when there is a high intake pressure available. Once the production fluid is pressurized to a sufficient level, the production fluid is fed into the ESP 30. Typically, the ESP 30 will comprise an intake, centrifugal stage pump unit 15, a motor 16, and a motor protector (and/or seal section) 17. The ESP 30 will further boost the pressure of the production fluid to a sufficient level to facilitate artificial lift of the fluid to the surface or to another location via an export line 40.

Figure 3:
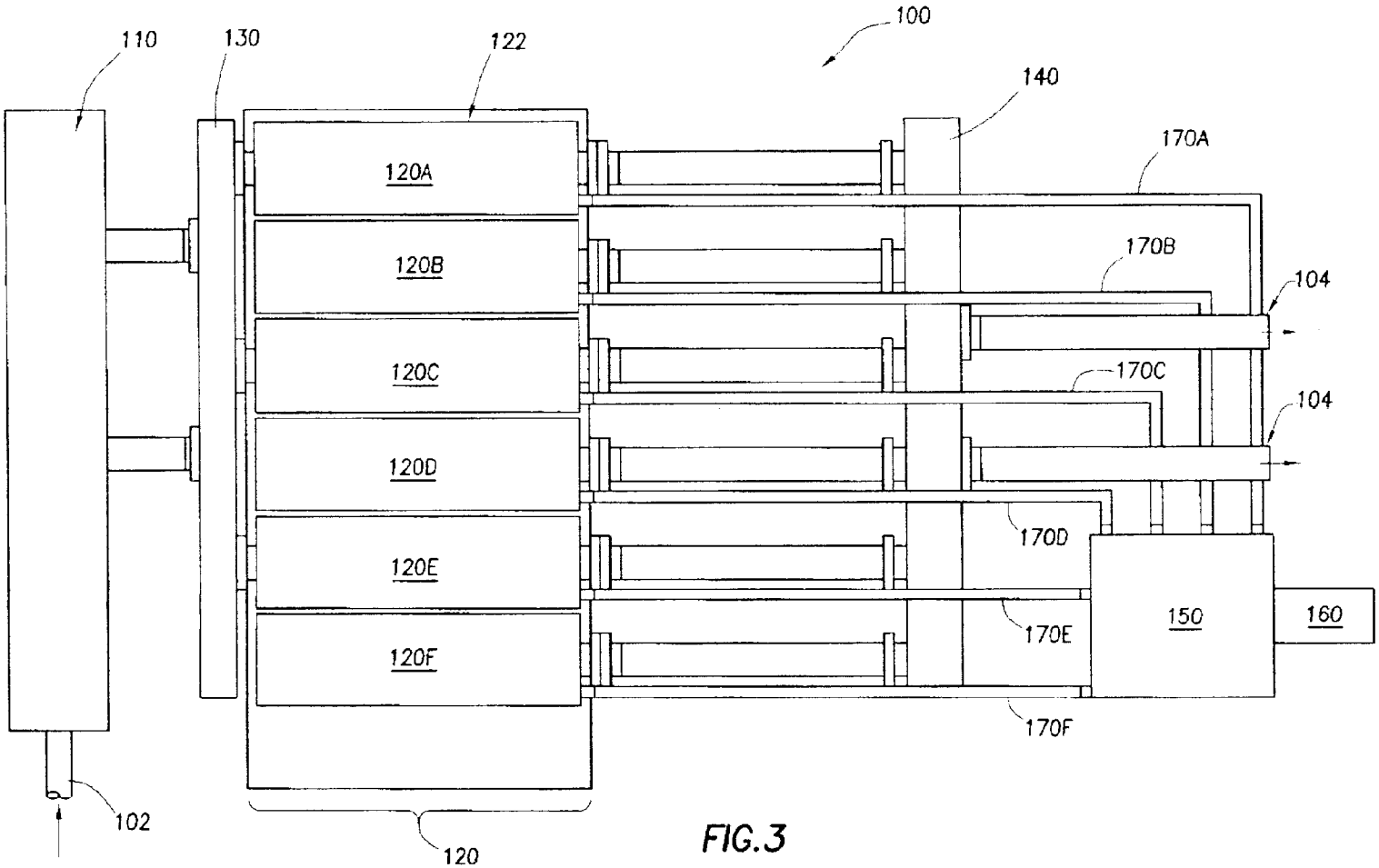
FIG. 3 illustrates an enlarged profile view of a composite pumping system in accordance with the present invention.

FIG. 3 shows one embodiment of a combination pumping system 100 in accordance with the present invention. The pumping system 100 includes a MPP 110 (or set of MPPs) hydraulically connected to one or more import lines 102. The MPP 110 is in-turn hydraulically (and in some embodiments mechanically) connected to ESP centrifugal stages 120 via a manifold 130 (or alternatively, via a housing or discharge line). In the illustrated embodiment, the set of ESPs 120 includes six ESPs 120A-F arranged in series, where only four of the ESPs (e.g., 120A-D) are operating at any given time and two of the ESPs (e.g., 120E-F) are in standby mode in the event that one or more operating ESPs fail. In alternative embodiments, any number of ESPs may be employed with or without standby, backup, or reserve ESPs. Moreover, in some embodiments, the set of ESPs may be arranged in parallel or in a combination of parallel and series ESPs. For example, a set of ESPs arranged in series may provide a greater boost in pressure but at a relatively low flow rate, while a set of ESPs arranged in parallel may provide a greater flow rate but provide a relatively lower pressure boost. The set of ESPs 120 are connected to an outtake manifold 140 for export via one or more export lines 104. In alternative embodiments, one or more MPPs may be hydraulically connected to one or more ESPs (and one or more ESPs may be hydraulically connected to one or more export lines) via any conduit including, but not limited to, a manifold, piping network, multi-phase and centrifugal stage housing, direct pipe or tubing, and so forth. In still other embodiments, the pumping system may be a direct-connect system without any manifolds.

In some embodiments of the present invention, a universal termination head (UTH) 160 (or other electrical power hub) is connected by power cables or jumpers to each ESP 130 and MPP (alternatively, the electrical connection can be established to each ESP through the shaft and housing connection) allowing the use of dry mate connections to facilitate power and control transmission to the MPPs and ESPs, as well as provide MPP makeup seal and motor lubrication fluids, reservoir fluid chemical treatment or hydraulic control fluids. In some embodiments, a power umbilical 170 may be connected to the UTH 160 using a wet mate connection (e.g., as by a remote operated subsea vehicle) to provide power and control functionality from a surface or other remote location. Moreover, the system may be installed on a skid or a series of skids or independently as the particular parameters of the job requires.

Still with respect to FIG. 3, in some embodiments, each ESP 120A-F is encapsulated in a housing 122 (e.g., pods or cans). Among other features and benefits, this facilitates the flow of production fluid around the motor component to provide a cooling effect when required. In some embodiments, a shroud is arranged around the motor to direct produced fluids past the motor before going into the ESP intake.

Figure 4:
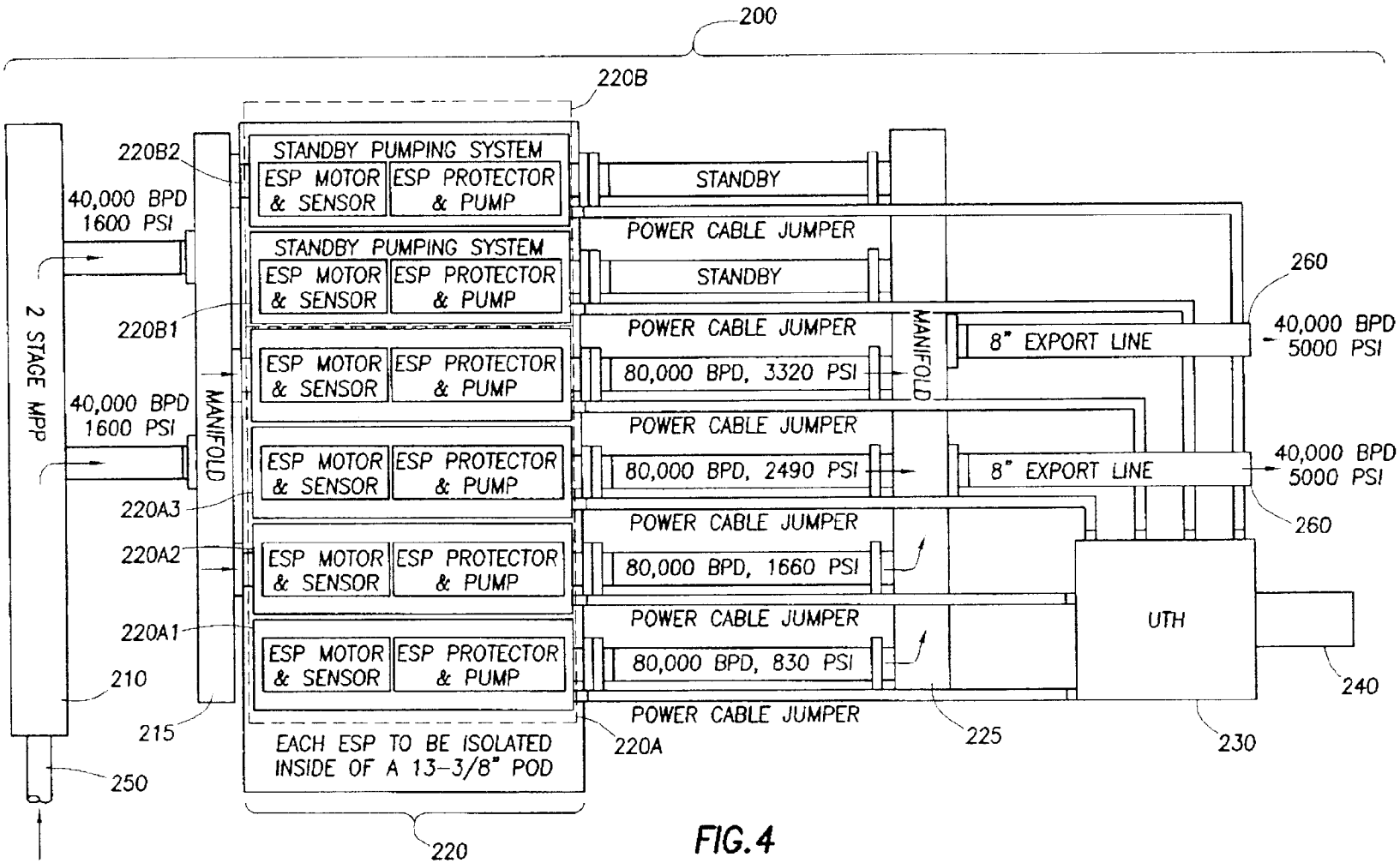
FIG. 4 illustrates an enlarged profile view of a composite pumping system as shown in FIG. 3 with example flow profiles and pumping characteristics.

FIG. 4 shows an example embodiment of a pumping system in accordance with the present invention. In this example, the pumping system 200 may be used for pumping a production fluid having a bubble point (i.e., pressure magnitude where gas component comes out of liquid solution) of approximately 1530 psi. The pumping system 200 comprises: a multiphase pump (e.g., a two-stage pump) 210 hydraulically connected to an import line 250; a set of electrical submersible pumps including a set of primary ESPs 220A (comprising 220A1 to 220A4) and a set of auxiliary or backup ESPs 220B (comprising 220B1 and 220B2); an intake manifold 215 and piping network for hydraulically connecting the MPP 210 and the set of ESPs 220; an outtake manifold 225 and piping network for hydraulically connecting the set of ESPs 220 and two export lines 260; a universal termination head 230 for allocating power from an umbilical 240 to the MPP 210 and ESP pumps 220A via power cable jumpers with dry mate connections; and a power umbilical 240 with a wet mate connection to the UTH 230.

In operation, the production fluid is pumped from the import line 250 into the MPP 210 to boost the production fluid flow to approximately 1600 psi at a combined rate of approximately 80,000 barrels per day (BPD). The production fluid flow is pumped from the MPP 210 into the intake manifold 215. The manifold 215 directs the flow of the production fluid into the primary set of ESPs 220A. The first ESP 220A1 boosts the pressure by approximately 830 psi to approximately 2430 psi. The production fluid flow then is directed into the second ESP 220A2, which boosts the pressure by approximately 830 psi to approximately 3260 psi. The production fluid flow then is directed into the third ESP 220A3, which boosts the pressure by approximately 830 psi to approximately 4090 psi. Finally, the production fluid flow is directed into the fourth ESP 220A4, which boosts the pressure by approximately 830 psi to approximately 4920 psi. The production fluid is then collected by the outtake manifold 225 and directed to the surface or another location via one or more export lines 260. Other embodiments of the pumping system may include various arrangements and configurations of MPP's and ESP's to facilitate boosting a production fluid having any particular bubble point such that the free gas in the fluid would either be above bubble point pressure or compressed sufficiently that it would not interfere with the performance of the ESP.

With reference again to FIG. 3, an embodiment of the present invention includes an operation for providing a composite pumping system 100 in a subsea environment. The composite pumping system 100 is formed by hydraulically connecting at least one MPP 110 and a set of at least one electrical submersible pumps 120. The composite pumping system 100 may be formed at the surface and deployed subsea, or deployed as disconnected components and assembled subsea. Some embodiments of the composite pumping system 100 may be assembled on a skid, while others embodiments are assembled without a skid. Once deployed and connected to an inflow of hydrocarbon fluid (e.g., via an import line 102 from the wellhead or other hydrocarbon source), the composite pumping system 100 imparts flow energy to the hydrocarbon fluid to generate an energized outlet hydrocarbon flow via an export line 104 to a target destination (e.g., the surface or subsea manifold or storage). In some embodiments, a power hub 160 (e.g., universal termination head) is electrically connected to each of the MPP 110 and set of at least one ESPs 120 to route electrical energy to the pumps via jumpers or cables. A power umbilical 170 is provided (e.g., by remote operated vehicle, or other remote mechanism) to electrically connect the power hub 160 to an electrical energy source located on the surface, the seabed, subsea, or even downhole.

In another embodiment of the present invention, a composite subsea pump includes a MPP integrated into a set of one or more ESPs through the use of mechanical connections (e.g., via a shaft and coupling) and hydraulic connections by way of the ESP housing. The MPP is mechanically connected to the ESP via a shaft coupling to drive both the ESP and MPP using a common motor. Moreover, in some embodiments, the MPP and ESP may also be arranged within a shared housing.

Figure 5A:
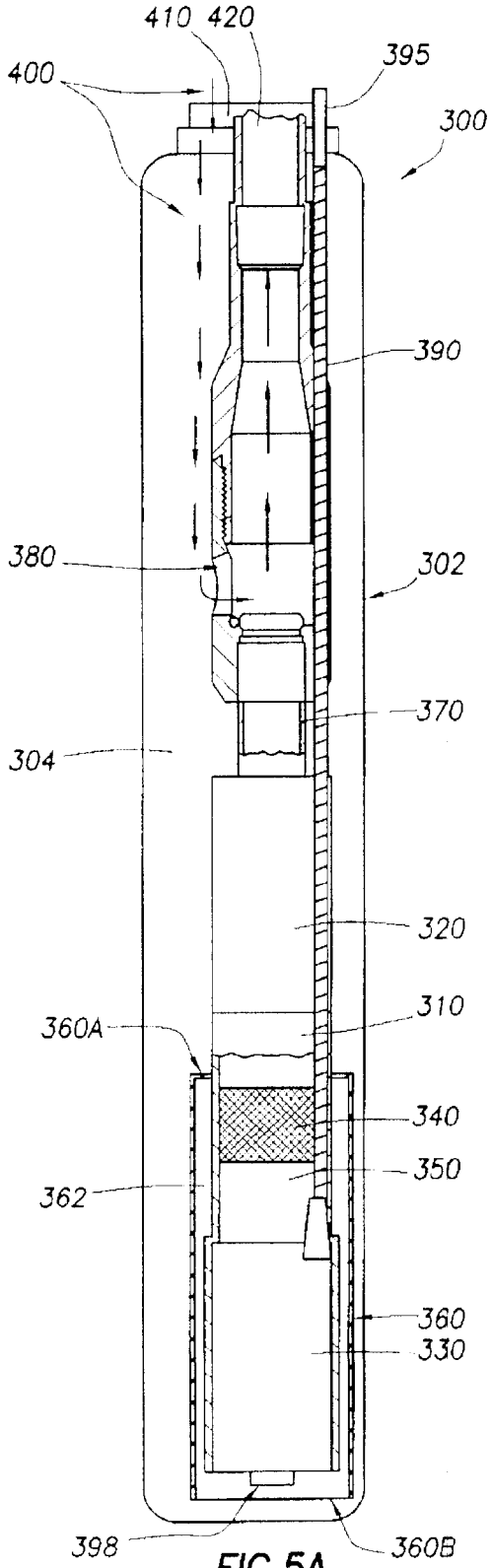
FIG. 5A illustrates a cross-sectional view of an embodiment of a composite/integral pump in a non-operating state.
Figure 5B:
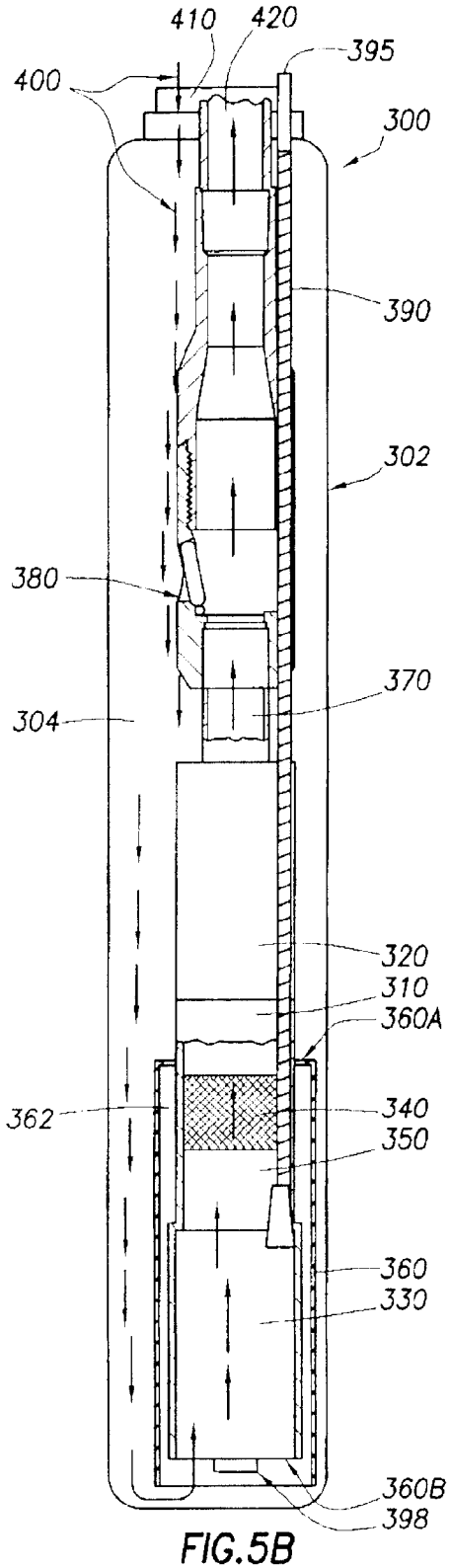
FIG. 5B illustrates a cross-sectional view of an embodiment of a composite/integral pump in an operating state.

For example, as shown in FIGS. 5A and 5B, an embodiment of the composite pump 300 includes: a sealed housing 302 (e.g., can, pod, or capsule) for containing the pumping components, the housing defining an inner annulus 304 for receiving a reservoir fluid 400 (e.g., hydrocarbon fluid) via an import line 410; a MPP 310; a centrifugal stage pump 320 (e.g., as used in an ESP); a pump motor 330 (e.g., an ESP pump motor) having a shaft for driving both the MPP 310 and the centrifugal stage pump 320; an intake 340 arranged between the motor 330 and the MPP 310 for receiving incoming reservoir fluid 400; a motor protector 350 (and/or seal) arranged between the MPP 310 and the motor 330; a shroud 360 having a top end 360A sealed above the intake 340 and a bottom end 360B open to the incoming reservoir fluid 400, the shroud defining an annulus 362 between the shroud and the motor 330; a pump discharge 370 for directing flow of the energized reservoir fluid 400 away from the composite pump 300 via an export line 420; a valve 380 (e.g., a one-way auto lift valve) for directing flow of the reservoir fluid 400 from the annulus 304 within the housing 302 directly into the export line 420 to bypass the intake 340 when the composite pump 300 is not operating; and an electrical motor lead extension 390 (e.g., cable) for connecting the motor 330 to an electrical source via a connector 395. In some embodiments, the connector 395 may be a dry mate connector to electrically connect the motor 330 to an energy source at the surface via an umbilical. The connector 395 penetrates the housing 302 and is sealed to prevent infiltration of seawater or other contaminates. Moreover, in some embodiments, the composite pump 300 may further include a sensor 398 (or a plurality of sensors). The sensor 398 may be used to determine any or all of the following: motor temperature, intake reservoir fluid pressure, intake reservoir fluid temperature, discharge reservoir fluid pressure, discharge reservoir fluid temperature, internal pressure of the reservoir fluid within the housing, and any other typical pump-related or reservoir fluid-related measurement.

In operation, when the composite pump 300 is off, the reservoir fluid 400 is directed into the annulus 304 of the housing 302 and into the export line 420 via the valve 380 to bypass the lower pump components.

When the composite pump 300 is on, the reservoir fluid 400 is directed into the annulus 304 of the housing 302 and drawn by the MPP 310 into the intake 340. The shroud 360 directs the reservoir fluid 400 past the motor 330 thus providing a cooling effect. The MPP 310 condition and pressures the reservoir fluid 400 and the centrifugal stage pump 320 provides the primary boost to energize the reservoir fluid 400. The reservoir fluid 400 is then directed into the export line 420 via the discharge 370.

While the invention has been disclosed with respect to a limited number of embodiments, those skilled in the art will appreciate numerous modifications and variations there from. It is intended that the appended claims cover such modifications and variations as fall within the true spirit and scope of the invention.

What is claimed is:

1. A system for moving a hydrocarbon fluid in a subsea environment, comprising:

at least one multiphase pump;

one or more electrical submersible pumps hydraulically connected to the multiphase pump;

an intake manifold connected between the multiphase pump and the one or more electrical submersible pumps, the intake manifold adapted to direct the hydrocarbon fluid from the at least one multiphase pump to the one or more electrical submersible pumps;

an electrical power hub electrically connected to the multiphase pump and the one or more electrical submersible pumps, the electrical power hub adapted to allocate electrical energy from an electrical power source to the multiphase pump and the one or more electrical submersible pumps; and an umbilical for connecting the electrical power hub to the power source.

2. The system of claim 1, further comprising:

an outtake manifold hydraulically connected between the one or more electrical submersible pumps and an export line, the outtake manifold adapted to direct the hydrocarbon fluid from the one or more electrical submersible pumps to another location via the export line.

3. The system of claim 1, further comprising:

an import line hydraulically connected to the multiphase pump, the import line adapted to direct the hydrocarbon fluid from a source location to the multiphase pump.

4. The system of claim 1, further comprising a housing enclosing each of the one or more electrical submersible pumps.

5. The system of claim 1, wherein the multiphase pump is a two-stage pump.

6. The system of claim 1, wherein the one or more electrical submersible pumps comprises a plurality of electrical submersible pumps connected in series.

7. A system for moving a hydrocarbon fluid in a subsea environment, comprising:

at least one multiphase pump;

one or more electrical submersible pumps hydraulically connected to the multiphase pump; and an intake manifold connected between the multiphase pump and the one or more electrical submersible pumps, the intake manifold adapted to direct the hydrocarbon fluid from the at least one multiphase pump to the one or more electrical submersible pumps, wherein the one or more electrical submersible pumps comprises a plurality of electrical submersible pumps connected in parallel.

8. A subsea pump for moving a reservoir fluid, comprising:

a housing having an opening for connection to an import line to receive the reservoir fluid;

a multiphase pump arranged within the housing;

a centrifugal stage pump arranged within the housing and hydraulically connected to the multiphase pump;

a motor arranged within the housing, the motor having a shaft adapted to operate the multiphase pump and the centrifugal stage pump;

an intake arranged between the motor and the multiphase pump; the intake hydraulically connected to the multiphase pump;

a tubular shroud arranged within the housing and surrounding the motor and intake; the tubular shroud adapted to direct reservoir fluid from the housing past the motor and into the intake; and a discharge arranged between the centrifugal stage pump and an export line.

9. The subsea pump of claim 8, further comprising:

a valve arranged within the housing between the discharge and the export line, the valve adapted to regulate communication between the housing and the discharge line, wherein the valve bypasses the intake when opened.

10. The subsea pump of claim 8, further comprising:

a protector arranged between the motor and the multiphase pump, the protector adapted to seal the motor from exposure to the reservoir fluid.

11. The subsea pump of claim 8, further comprising:

a sensor arranged within the housing, the sensor adapted to detect pump or reservoir fluid conditions.

12. The subsea pump of claim 8, further comprising:

an electrical connector adapted to penetrate the housing and provide electrical communication via an electrical energy source; and a motor lead extension arranged within the housing and electrically connecting the motor to the electrical connector.

13. The subsea pump of claim 12, wherein the electrical connector is a dry mate connector.

* * * * *